US008640974B2

(12) United States Patent
Bathina

(10) Patent No.: US 8,640,974 B2
(45) **Date of Patent: *Feb. 4, 2014**

(54) SYSTEM AND METHOD FOR COOLING A NOZZLE

(75) Inventor: Mahesh Bathina, Bangalore (IN)

(73) Assignee: General Electric Company, Schenectady, NY (US)

( * ) Notice: Subject to any disclaimer, the term of this patent is extended or adjusted under 35 U.S.C. 154(b) by 657 days.

This patent is subject to a terminal disclaimer.

(21) Appl. No.: 12/911,137

(22) Filed: Oct. 25, 2010

(65) Prior Publication Data

US 2012/0097757 A1 Apr. 26, 2012

(51) Int. Cl.
*B05B 7/10* (2006.01)

(52) U.S. Cl.
USPC ..... 239/403; 239/132; 239/132.3; 239/132.5; 239/405; 239/406; 60/39.83; 60/737; 60/912

(58) Field of Classification Search
USPC ..... 239/13, 128, 132, 132.3, 132.5, 400, 239/402–406; 60/39.83, 737, 740, 748, 912
See application file for complete search history.

(56) References Cited

U.S. PATENT DOCUMENTS

| | | | | |
|---|---|---|---|---|
| 4,112,675 | A | 9/1978 | Pillsbury et al. | |
| 4,405,853 | A | 9/1983 | Klein | |
| 4,455,470 | A | 6/1984 | Klein | |
| 4,483,137 | A * | 11/1984 | Faulkner | 60/748 |
| 5,273,212 | A | 12/1993 | Gerhardus et al. | |
| 5,836,163 | A * | 11/1998 | Lockyer et al. | 60/737 |
| 5,954,491 | A | 9/1999 | Helton et al. | |
| 6,003,296 | A | 12/1999 | Citeno et al. | |
| 6,179,608 | B1 | 1/2001 | Kraemer et al. | |
| 6,357,216 | B1 | 3/2002 | Scott et al. | |
| 6,429,020 | B1 | 8/2002 | Thornton et al. | |
| 6,530,207 | B2 | 3/2003 | Tobo et al. | |
| 6,588,213 | B2 | 7/2003 | Newburry | |
| 6,599,028 | B1 | 7/2003 | Shu et al. | |
| 6,632,084 | B2 | 10/2003 | Berenbrink | |
| 6,786,047 | B2 | 9/2004 | Bland et al. | |
| 6,978,074 | B2 | 12/2005 | Shu et al. | |
| 7,197,880 | B2 | 4/2007 | Thornton et al. | |
| 7,370,466 | B2 | 5/2008 | Cai | |
| 7,513,098 | B2 | 4/2009 | Ohri et al. | |
| 7,513,115 | B2 | 4/2009 | Stuttaford | |
| 2006/0010878 | A1 * | 1/2006 | Widener | 60/740 |
| 2007/0006596 | A1 | 1/2007 | Fujii | |
| 2007/0101722 | A1 | 5/2007 | Hoffman | |
| 2007/0277528 | A1 | 12/2007 | Homitz et al. | |
| 2008/0148736 | A1 | 6/2008 | Ishizaka et al. | |
| 2008/0184708 | A1 | 8/2008 | Moriwaki et al. | |
| 2009/0293482 | A1 | 12/2009 | Davis, Jr. et al. | |

* cited by examiner

*Primary Examiner* — Steven J Ganey
(74) *Attorney, Agent, or Firm* — Dority & Manning, PA

(57) ABSTRACT

A nozzle includes a center body and a shroud circumferentially surrounding at least a portion of the center body to define an annular passage between the center body and the shroud. A plurality of apertures pass through the center body to the annular passage, and a plenum extends inside the center body and is in fluid communication with the plurality of apertures. A cooling medium is in fluid communication with the plenum. A method for cooling a nozzle includes flowing a cooling medium through a plenum across a surface of the nozzle.

13 Claims, 6 Drawing Sheets

SYSTEM AND METHOD FOR COOLING A NOZZLE

FIELD OF THE INVENTION

The present invention generally involves a system and method for cooling a nozzle. In particular, embodiments of the present invention may provide a cooling medium to cool surfaces of the nozzle.

BACKGROUND OF THE INVENTION

Gas turbines are widely used in industrial and power generation operations. A typical gas turbine includes an axial compressor at the front, one or more combustors around the middle, and a turbine at the rear. Ambient air enters the compressor, and rotating blades and stationary vanes in the compressor progressively impart kinetic energy to the air to produce a compressed working fluid at a highly energized state. The compressed working fluid exits the compressor and flows through nozzles in the combustors where it mixes with fuel and ignites to generate combustion gases having a high temperature and pressure. The combustion gases expand in the turbine to produce work. For example, expansion of the combustion gases in the turbine may rotate a shaft connected to a generator to produce electricity.

It is widely known that the thermodynamic efficiency of a gas turbine increases as the operating temperature, namely the combustion gas temperature, increases. However, if the fuel and air are not evenly mixed prior to combustion, localized hot spots may form in the combustor. The localized hot spots increase the chance for the flame in the combustor to flash back into the nozzles and/or become attached inside the nozzles which may damage the nozzles. Although flame flash back and flame holding may occur with any fuel, they occur more readily with high reactive fuels, such as hydrogen, that have a higher burning rate and a wider flammability range.

A variety of techniques exist to allow higher operating temperatures while minimizing flash back and flame holding. Many of these techniques seek to reduce localized hot spots and/or reduce low flow zones to prevent or reduce the occurrence of flash back or flame holding. For example, continuous improvements in nozzle designs result in more uniform mixing of the fuel and air prior to combustion to reduce or prevent localized hot spots from forming in the combustor. Alternately, or in addition, nozzles have been designed to ensure a minimum flow rate of fuel and/or air through the nozzle to cool the nozzle surfaces and/or prevent the combustor flame from flashing back into the nozzle. However, continued improvements in nozzle designs to reduce and/or prevent the occurrence of flame holding or flash back would be useful.

BRIEF DESCRIPTION OF THE INVENTION

Aspects and advantages of the invention are set forth below in the following description, or may be obvious from the description, or may be learned through practice of the invention.

One embodiment of the present invention is a nozzle that includes a center body and a shroud circumferentially surrounding at least a portion of the center body to define an annular passage between the center body and the shroud. A plurality of apertures pass through the center body to the annular passage, and a plenum extends inside the center body and is in fluid communication with the plurality of apertures. A cooling medium is in fluid communication with the plenum.

Another embodiment of the present invention is a nozzle that includes a center body and a shroud circumferentially surrounding at least a portion of the center body to define an annular passage between the center body and the shroud. The shroud defines a plurality of passages through the shroud to the annular passage, and a plenum is in fluid communication with the plurality of passages through the shroud. A cooling medium is in fluid communication with the plenum.

The present invention also includes a method for cooling a nozzle. The method includes flowing a cooling medium through a plenum across a surface of the nozzle.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
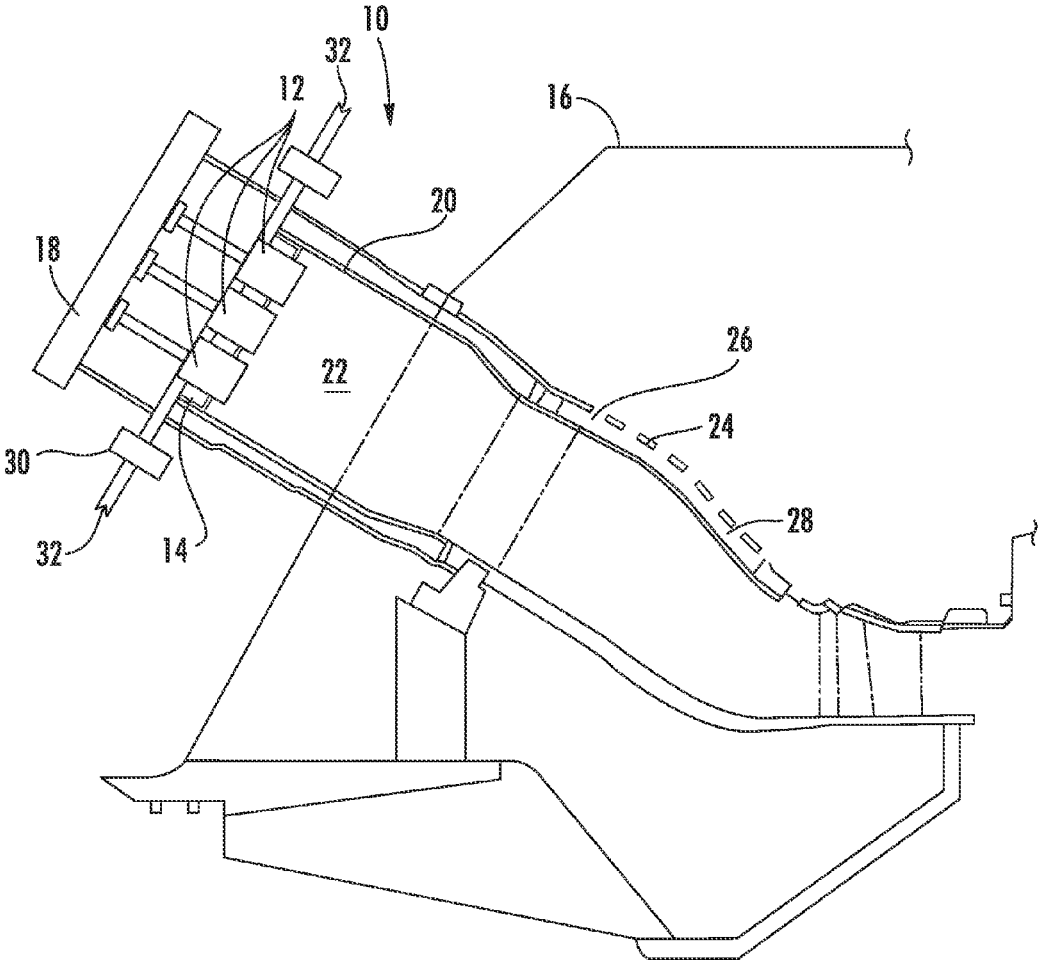
FIG. 1 is a simplified side cross-section view of a combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide cooling to nozzle surfaces to reduce the occurrence of flame holding and, if flame holding occurs, to reduce and/or prevent any damage to the nozzle surfaces. Particular embodiments may include a supply of cooling medium that flows a cooling medium through or across nozzle surfaces to cool the nozzle through film and/or effusion cooling of the nozzle.

FIG. 1 shows a simplified cross-section of a combustor 10 according to one embodiment of the present invention. As shown, the combustor 10 generally includes one or more nozzles 12 radially arranged in a top cap 14. A casing 16 may surround the combustor 10 to contain the air or compressed working fluid exiting the compressor (not shown). An end cap 18 and a liner 20 may define a combustion chamber 22 downstream of the nozzles 12. A flow sleeve 24 with flow holes 26 may surround the liner 20 to define an annular passage 28 between the flow sleeve 24 and the liner 20.

Figure 2:
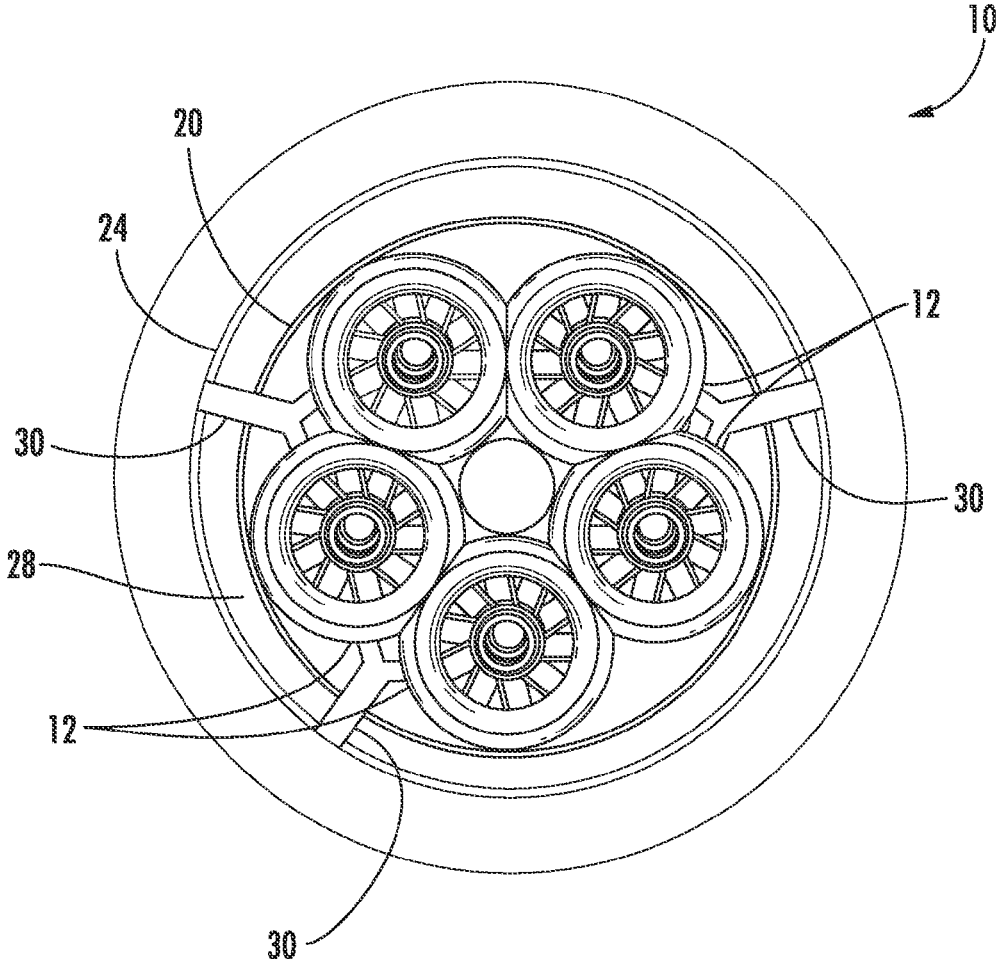
FIG. 2 is an axial cross-section view of the combustor shown in FIG. 1.

FIG. 2 provides a top plan view of the combustor 10 shown in FIG. 1. Various embodiments of the combustor 10 may include different numbers and arrangements of nozzles. For example, in the embodiment shown in FIG. 2, the combustor 10 includes five nozzles 12 radially arranged. The working fluid flows through the annular passage 28 between the flow sleeve 24 and the liner 20 until it reaches the end cap 18 where it reverses direction to flow through the nozzles 12 and into the combustion chamber 22.

As shown in FIGS. 1 and 2, a manifold 30 may connect to the nozzles 12 to supply a cooling medium 32 to, through, and/or over the nozzles 12. The manifold 30 may include any pipe and valve arrangement known to one of ordinary skill in the art for providing fluid communication. The cooling medium 32 may comprise any fluid suitable for removing heat and that can also pass through the combustion chamber 22 and downstream components. For example, the cooling medium 32 may comprise steam, an inert gas, a diluent, or another suitable fluid known to one of ordinary skill in the art.

Figure 3:
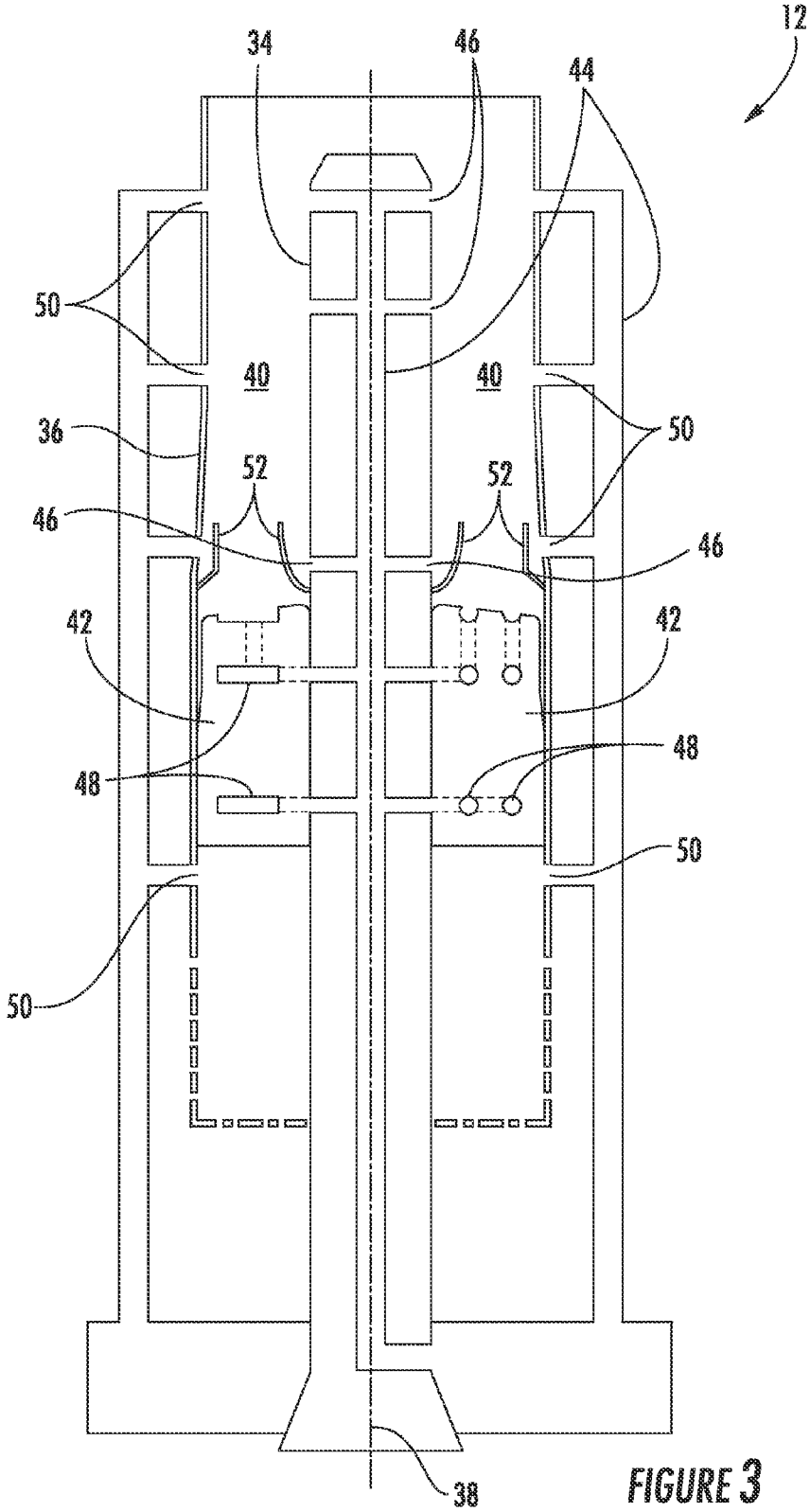
FIG. 3 is a simplified side cross-section view of a nozzle according to an embodiment of the present invention.

FIG. 3 shows a simplified cross-section of the nozzle 12 according to one embodiment of the present invention. As shown in FIG. 3, the nozzle 12 generally includes a center body 34 and a shroud 36. The center body 34 generally extends along an axial centerline 38 of the nozzle 12. The shroud 36 circumferentially surrounds at least a portion of the center body 34 to define an annular passage 40 between the center body 34 and the shroud 36. The nozzle 12 may further include vanes 42 in the annular passage 40 between the center body 34 and the shroud 36 that impart tangential velocity to fuel and/or working fluid flowing over the vanes 42. In this manner, working fluid may flow through the annular passage 40 and mix with fuel injected into the annular passage 40 from the center body 34 and/or vanes 42.

As shown in FIG. 3, the nozzle 12 may further include a plenum 44 extending inside the center body 34 and/or outside the nozzle 12 along the shroud 36 and a plurality of holes, apertures, ports, or passages that provide fluid communication between the plenum 44 and the annular passage 40. As used herein, the terms "holes", "apertures", "ports", and "passages" are intended to be substantially identical in meaning and may be used as synonyms for one another. The plenum 44 is in fluid communication with the supply of cooling medium 32 and distributes the cooling medium 32 to the center body 34, shroud 36, and/or vanes 42. As shown in FIG. 3, the center body 34 may further define a plurality of apertures 46 through the center body 34 to the annular passage 40. As a result, the cooling medium 32 may flow from the supply of cooling medium 32, through the plenum 44 in the center body 34, and out of the apertures 46 into the annular passage 40. In this manner, the cooling medium may stream along the external surface of the center body 34 to provide film cooling to the center body 34 to remove heat from the nozzle 12.

Figure 4:
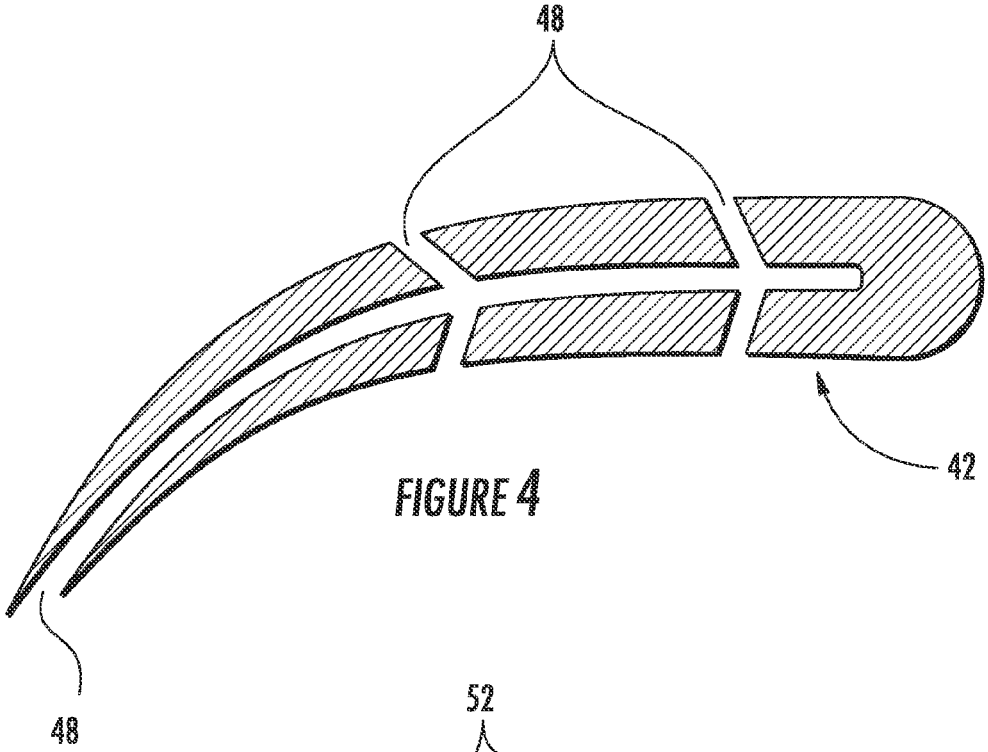
FIG. 4 is a side cross-section view of a vane shown in FIG. 3.
Figure 5:
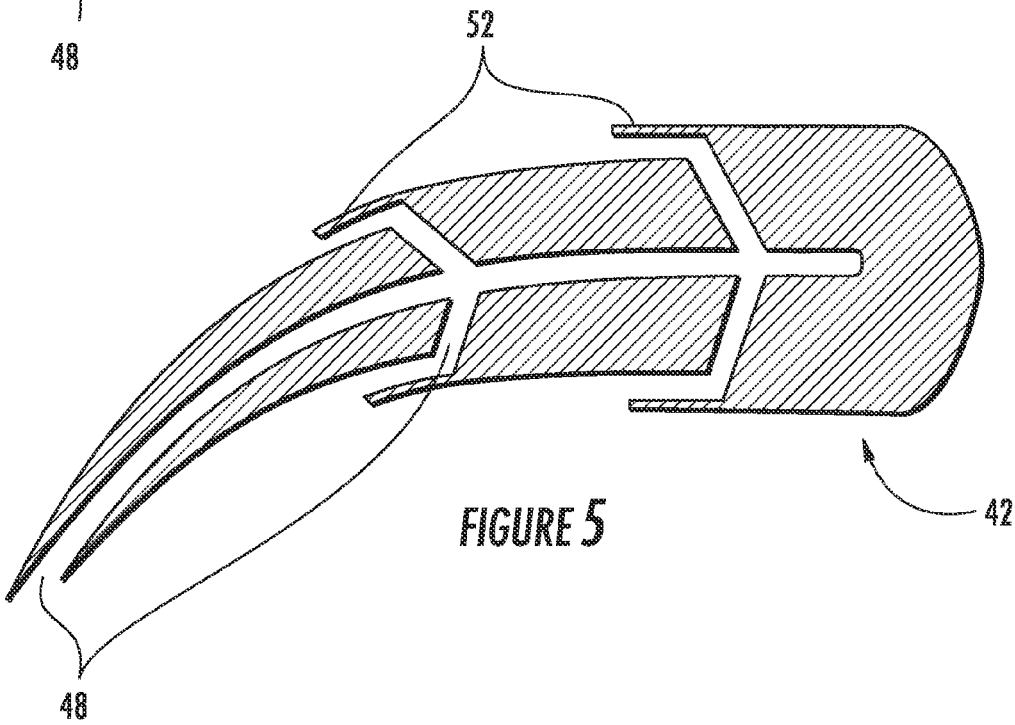
FIG. 5 is a side cross-section view of a vane shown in FIG. 3 according to an alternate embodiment.

As further shown in FIGS. 3, 4, and 5, the vanes 42 may define a plurality of ports 48 through the vanes 42 to the annular passage 40. The ports 48 may be on one or both sides of the vanes 42 and/or at the tip of the vanes 42. In this manner, the cooling medium 32 may flow from the supply of cooling medium 32, through the plenum 44 to the vanes 42, and out of the vanes 42 to provide film cooling to one or more surfaces of the vanes 42 to remove heat from the nozzle 12.

The shroud 36 may similarly define a plurality of passages 50 through the shroud 36 to the annular passage 40. As shown in FIG. 3, the plenum 44 may provide a fluid communication for the cooling medium 32 to flow through the plenum 44 and through the plurality of passages 50 through the shroud 36 to the annular passage 40. As the cooling medium 32 flows through the plurality of passages 50, it provides film cooling to the inner surface of the shroud 36 to remove heat from the nozzle 12.

Multiple variations in the apertures 46, ports 48, and passages 50 are possible and within the scope of particular embodiments of the present invention. For example, the apertures 46, ports 48, and passages 50 may comprise any geometric shape and may be disposed at various angles with respect to the axial centerline 38 to vary the radial, axial, or tangential velocity of the cooling medium 32 flowing through the respective apertures 46, ports 48, and/or passages 50 and into the annular passage 40. Alternatively, or in addition, a louver 52, fin, or similar structure may be located proximate to one or more of the apertures 46, ports 48, and/or passages 50 to redirect the cooling medium 32 flowing through the respective apertures 46, ports 48, and/or passages 50. The louver 52, fin, or similar structure may be straight, angled, or curved with respect to the axial centerline 38 to impart the desired radial, axial, or tangential velocity to the cooling medium 32. For example, as shown in FIG. 3, particular embodiments within the scope of the present invention may include louvers 52 located directly upstream of select apertures 46 and passages 50 to redirect the cooling medium 32 along the surfaces of the center body 34 and shroud 36, respectively, to improve film cooling provided by the cooling medium 32 to the center body 34 and shroud 36. Similarly, the vanes 42 may include louvers 52 proximate to one or more ports 48 on one or both sides. In addition, as shown in FIG. 5, the thickness of the vanes 42 may progressively decrease downstream of each louver 52. In this manner, the louver 52 may be substantially flush with the upstream surface of the vanes 42 and to redirect the cooling medium 32 flowing downstream of the louver 52 without affecting the fluid flow path upstream of the louver 52. Particular embodiments within the scope of the present invention may include similar changes in the thickness or surface profile of the center body 34 and/or shroud 36. The actual geometric shape, angle, and location of apertures 46, ports 48, and passages 50 and/or use of louvers 52 will be selected based on numerous design and operational considerations, such as, for example, the anticipated fuel, the fuel flow rate, and/or the working fluid flow rate.

Figure 6:
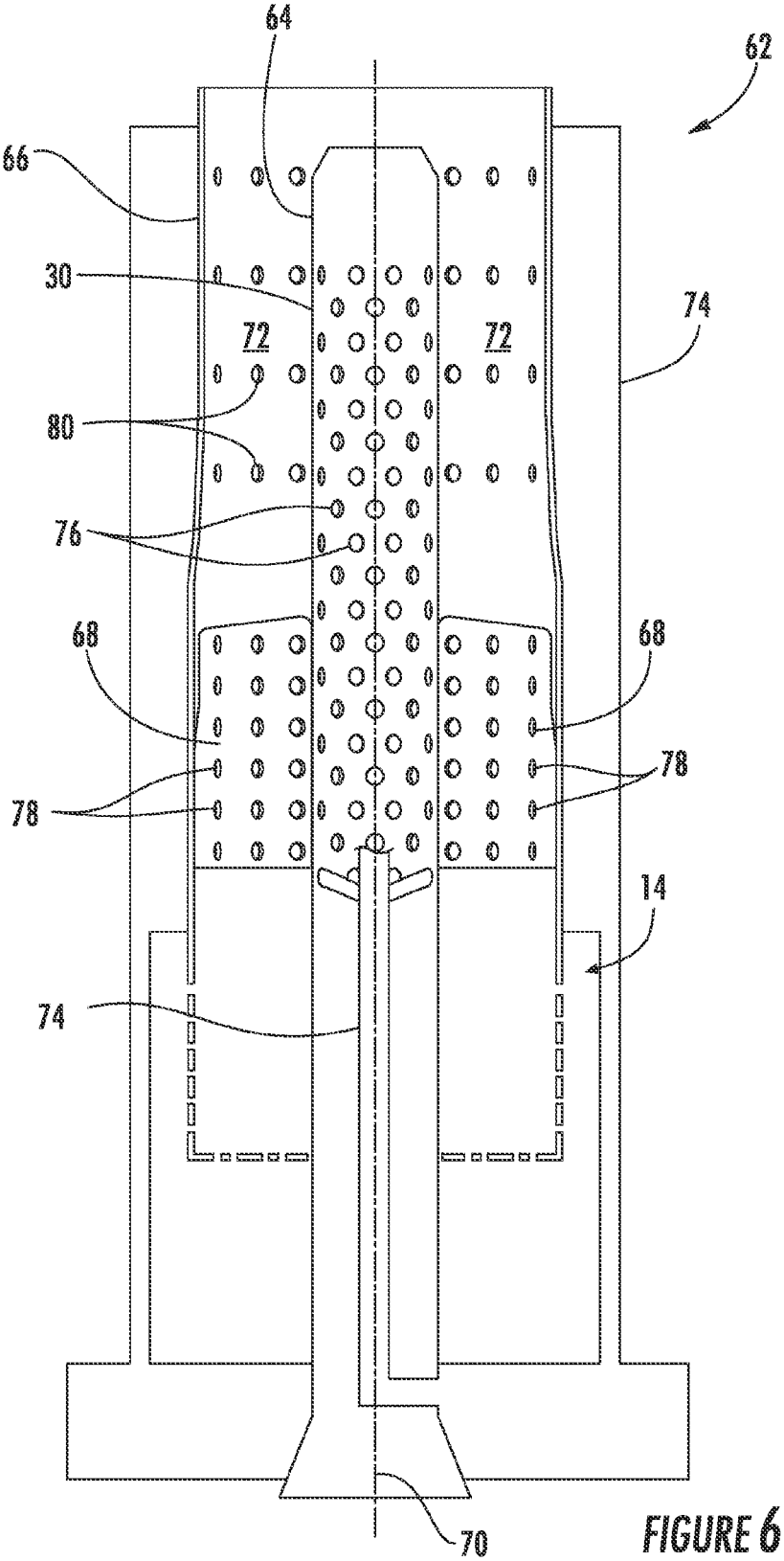
FIG. 6 is a simplified side cross-section view of a nozzle according to an alternate embodiment of the present invention.

FIG. 6 provides a nozzle 62 according to an alternate embodiment of the present invention. The nozzle 62 may again include a center body 64, a shroud 66, and one or more vanes 68 as previously described with respect to FIG. 3. Specifically, the center body 64 generally extends along an axial center line 70 of the nozzle 62, and the shroud 66 circumferentially surrounds at least a portion of the center body 64 to define an annular passage 72 between the center body 64 and the shroud 66. The vanes 68, if present, impart tangential velocity to fuel and/or working fluid flowing over the vanes 68. In this manner, working fluid may flow through the annular passage 72 and mix with fuel injected into the annular passage 72 from the center body 64 and/or vanes 68.

Figure 7:
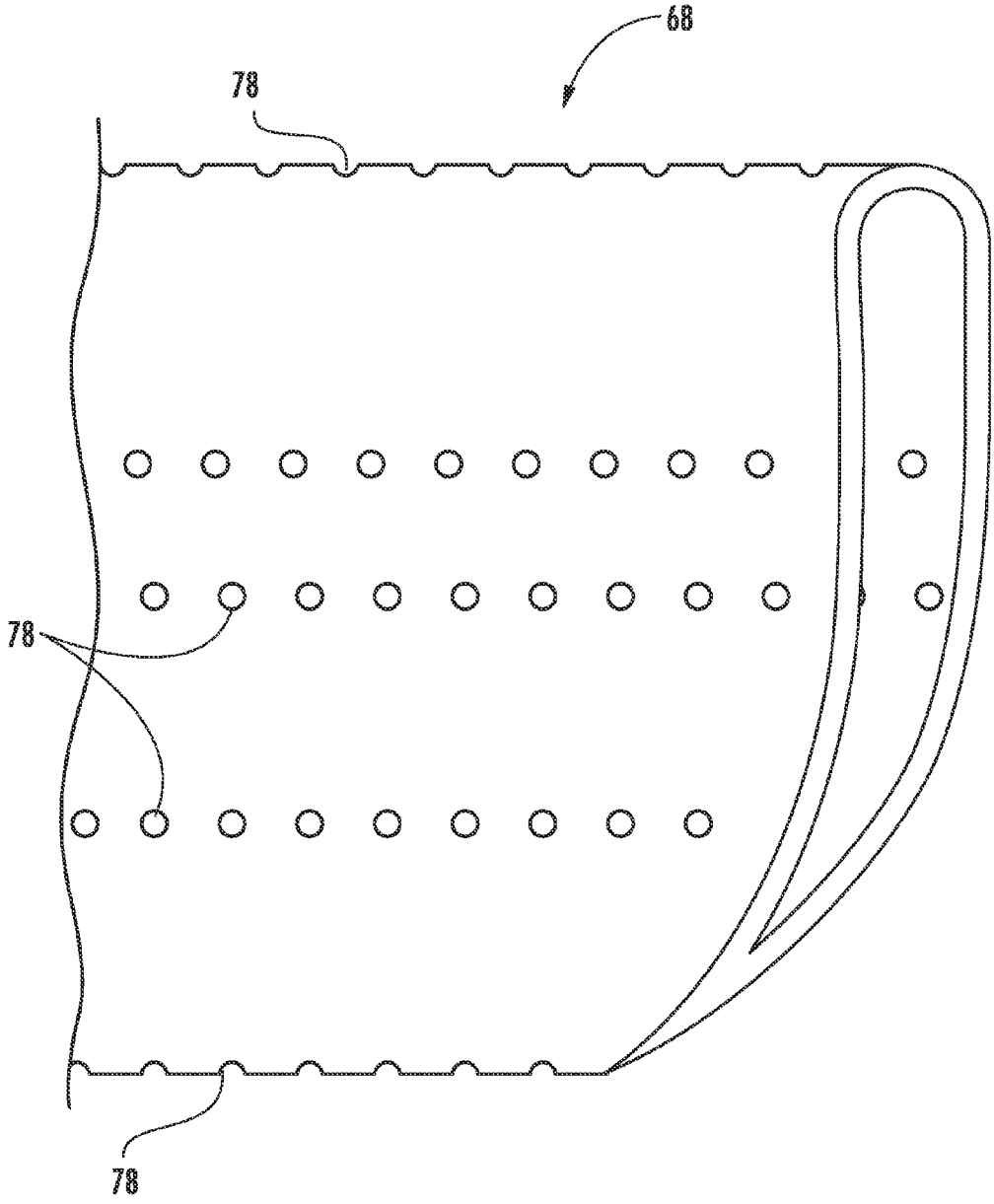
FIG. 7 is a perspective view of a vane shown in FIG. 6.

In the embodiment shown in FIG. 6, a plenum 74 extends into the center body 64 and/or outside the nozzle 62 around the shroud 66. The plenum 74 is in fluid communication with the supply of cooling medium 32 and distributes the cooling medium 32 to the center body 64, shroud 66, and/or vanes 68. As shown in FIG. 6, the center body 64 may further define a plurality of apertures 76, the vanes 68 may further define a plurality of ports 78, and the shroud 66 may further define a plurality of passages 80. The apertures 76, ports 78, and passages 80 are generally smaller and more closely spaced than the analogous apertures 46, ports 48, and passages 50 previously described with respect to the embodiments shown in FIGS. 3, 4, and 5. For example, as shown in FIG. 7, the ports 78 in the vanes 68 are closely spaced to provide effusion cooling to the surfaces of the vanes 68 and/or the trailing and leading edges of the vanes 68. In this manner, the cooling medium 32 may flow through the plenum 74 and out one or more of the apertures 76 in the center body 64, ports 78 in the vanes 68, and/or passages 80 in the shroud 66 to provide effusion cooling to the surfaces of the center body 64, vanes 68, and/or shroud 66.

One of ordinary skill in the art will readily appreciate that the embodiments shown in FIGS. 3, 4, 5, 6 and 7 provide a method for cooling the nozzle 12, 62. Specifically, the method flows a cooling medium 32 through the plenum 44, 74 and across the surface of the nozzle 12, 62. For example, the method may include flowing the cooling medium 32 through the center body 34, 64, vanes 42, 68, and/or shroud 36, 66 to provide film and/or effusion cooling to the surfaces of the nozzle 12, 62.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A nozzle comprising:

a. a center body;

b. a shroud circumferentially surrounding at least a portion of the center body to define an annular passage between the center body and the shroud;

c. a plurality of apertures through the center body to the annular passage;

d. a plenum extending inside the center body and in fluid communication with the plurality of apertures;

e. at least one vane between the center body and the shroud, wherein the at least one vane defines a plurality of ports through the at least one vane to the annular passage; and f. a cooling medium in fluid communication with the plenum.

2. The nozzle as in claim 1, wherein the cooling medium comprises at least one of steam, an inert gas, or a diluent.

3. The nozzle as in claim 1, wherein the plenum is in fluid communication with the plurality of ports in the at least one vane.

4. The nozzle as in claim 1, wherein the shroud defines a plurality of passages through the shroud to the annular passage.

5. The nozzle as in claim 4, wherein the plenum is in fluid communication with the plurality of passages through the shroud.

6. The nozzle as in claim 1, further comprising a louver connected to the center body and proximate to at least one of the plurality of apertures.

7. A nozzle comprising:

a. a center body;

b. a shroud circumferentially surrounding at least a portion of the center body to define an annular passage between the center body and the shroud, wherein the shroud defines a plurality of passages through the shroud to the annular passage;

c. a plenum in fluid communication with the plurality of passages through the shroud;

d. at least one vane between the center body and the shroud, wherein the at least one vane defines a plurality of ports through the at least one vane to the annular passage; and e. a cooling medium in fluid communication with the plenum.

8. The nozzle as in claim 7, wherein the cooling medium comprises at least one of steam, an inert gas, or a diluent.

9. The nozzle as in claim 7, wherein the plenum is in fluid communication with the plurality of ports through the at least one vane.

10. The nozzle as in claim 7, wherein the plenum extends inside the center body and is in fluid communication with the plurality of ports through the at least one vane.

11. The nozzle as in claim 7, wherein the center body defines a plurality of apertures through the center body to the annular passage.

12. The nozzle as in claim 11, wherein the plenum extends inside the center body and is in fluid communication with the plurality of apertures through the center body.

13. The nozzle as in claim 7, further comprising a louver connected to the shroud and proximate to at least one of the plurality of passages.

* * * * *